US010309705B2

(12) United States Patent
Zhao et al.

(10) Patent No.: US 10,309,705 B2
(45) Date of Patent: Jun. 4, 2019

(54) TWO-STAGE COMPRESSION AIR CONDITIONING SYSTEM AND METHOD OF CONTROLLING GAS REPLENISHMENT THEREOF

(71) Applicant: Gree Electric Appliances, Inc. of Zhuhai, Zhuhai (CN)

(72) Inventors: Huan Zhao, Zhuhai (CN); Feng Tan, Zhuhai (CN); Pengfei Li, Zhuhai (CN); Youxuan Liang, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 0 days.

(21) Appl. No.: 15/996,981

(22) Filed: Jun. 4, 2018

(65) Prior Publication Data

US 2018/0283755 A1 Oct. 4, 2018

Related U.S. Application Data

(63) Continuation of application No. PCT/CN2016/107254, filed on Nov. 25, 2016.

(30) Foreign Application Priority Data

Dec. 14, 2015 (CN) ..... 2015 1 0929233

(51) Int. Cl.
*F25B 49/02* (2006.01)
*F25B 1/10* (2006.01)
*F25B 13/00* (2006.01)

(52) U.S. Cl.
CPC ..... *F25B 49/022* (2013.01); *F25B 1/10* (2013.01); *F25B 49/02* (2013.01); *F25B 13/00* (2013.01);

(Continued)

(58) Field of Classification Search
CPC ..... F25B 49/022; F25B 1/10; F25B 13/00
See application file for complete search history.

(56) References Cited

U.S. PATENT DOCUMENTS 5,934,094 A 8/1999 Itoh et al.
2014/0151015 A1* 6/2014 Sun ..... F25B 1/10 165/253

FOREIGN PATENT DOCUMENTS

CN 200996753 Y 12/2007
CN 202692341 U 1/2013
(Continued)

OTHER PUBLICATIONS

Wang et al., Air Conditioner Circulating System . . . of Dual-Stage Compressor, Feb. 12, 2014, CN103574852A, Whole Document.*

*Primary Examiner* — Larry L Furdge
(74) *Attorney, Agent, or Firm* — The Webb Law Firm

(57) ABSTRACT

Described is a two-stage compression air conditioning system and a method of controlling gas replenishment thereof. The two-stage compression air conditioning system includes a two-stage compressor and a flash evaporator, wherein a first port of the flash evaporator is connected to one end of a stop valve by a first pipeline and the other end of the stop valve is connected to a first gas intake of the two-stage compressor by a second pipeline. The method of controlling gas replenishment includes: obtaining a first temperature value and an intermediate pressure value in the first pipeline, and a second temperature value in the second pipeline; and controlling the stop valve according to the first temperature value, the intermediate pressure value and the second temperature value.

17 Claims, 2 Drawing Sheets

(52) U.S. Cl.
CPC ..... *F25B 2400/23* (2013.01); *F25B 2500/19* (2013.01); *F25B 2600/2509* (2013.01)

(56) References Cited

FOREIGN PATENT DOCUMENTS

| | | | | |
|---|---|---|---|---|
| CN | 103574852 | A | * | 2/2014 |
| CN | 103574852 | A | | 2/2014 |
| CN | 103822418 | A | | 5/2014 |
| CN | 105371514 | A | | 3/2016 |
| CN | 105485989 | A | | 4/2016 |
| CN | 205191969 | U | | 4/2016 |
| CN | 205227959 | U | | 5/2016 |
| EP | 0919410 | A2 | | 6/1999 |
| JP | 2005214442 | A | | 8/2005 |

* cited by examiner

TWO-STAGE COMPRESSION AIR CONDITIONING SYSTEM AND METHOD OF CONTROLLING GAS REPLENISHMENT THEREOF

CROSS-REFERENCE TO RELATED APPLICATIONS

This application is a U.S. continuation of International Application No. PCT/CN2016/107254 filed Nov. 25, 2016, which claims priority to Chinese Patent Application No. 201510929233.4 filed Dec. 14, 2015, the disclosures of which are hereby incorporated in their entirety by reference.

BACKGROUND OF THE INVENTION

Field of the Invention

The disclosure relates to the field of air conditioning, and in particular relates to a two-stage compression air conditioning system and a method of controlling gas replenishment thereof.

Description of Related Art

A lower ambient temperature results in a greater demand for air-conditioning heating capacity. However, current single-stage compression heat pumps can be normally started to operate only at 20 degrees below zero, the heating capacity is greatly reduced, the heating effect cannot be guaranteed, and the reliability of the air-conditioning unit is also subject to a severe test.

Compared with a single-stage compression heat pump, a two-stage compression air-conditioning system with enhanced vapor injection has a greater heating capacity and a higher energy efficiency at a low temperature. Moreover, the two-stage compression air conditioning system can reduce the pressure ratio of the single-stage compressor, lower the exhaust temperature, and also improve the intake efficiency and compression efficiency, thereby improving the heating capacity and heating efficiency.

A two-stage compressor with enhanced vapor injection is divided into a high-pressure stage and a low-pressure stage. The two-stage compressor has two or more cylinders, wherein the cylinder for the first-stage compression is called a low-pressure cylinder and the cylinder for the second-stage compression is called a high-pressure cylinder. The principle of enhanced vapor injection is to inject a gaseous refrigerant into the gas intake of the high-pressure cylinder of the compressor from the enhanced vapor injection port in the middle portion of the compressor. The injected gaseous refrigerant will be mixed with the refrigerant discharged after being compressed by the low-pressure cylinder and then enter the high-pressure cylinder for compression.

In a two-stage compression air-conditioning system, gas injection in the middle has a very important influence on the system performance and reliability. With the difference in the compression ratios of high and low pressure stages and the change of working conditions, back flow of replenished gas is likely to occur in the two-stage compression system. The back flow of replenished gas means that, when the gas replenishing valve is opened, since the intermediate pressure of the flash evaporator is lower than the exhaust pressure of first-stage compression, part of the exhaust of the first-stage compression is directly discharged into the intermediate flash evaporator. Backflow of replenished gas greatly affects the reliability and performance of the two-stage compression system. When the exhaust of the first-stage compression is directly discharged into the flash evaporator, the lubricating oil will be discharged together, which is likely to cause oil starvation and wear of the compressor. In terms of performance, after entering the flash evaporator without being condensed and throttled, the high-temperature and high-pressure exhaust is mixed with the low-temperature and low-pressure refrigerant that has been condensed and throttled, which increases the temperature and pressure of the refrigerant before entering the flash evaporator, which correspondingly reduces the quantity of outdoor heat exchange and directly leads to the reduction of the quantity of indoor heat exchange and the deterioration of the energy efficiency of the system.

Related two-stage compression air conditioning systems do not determine and control back flow of replenished gas, so it is difficult to avoid the occurrence of back flow of replenished gas.

SUMMARY OF THE INVENTION

The following technical solution is adopted according to one aspect of the present disclosure: a method of controlling gas replenishment of a two-stage compression air conditioning system, the two-stage compression air conditioning system comprising a two-stage compressor and a flash evaporator, wherein a first port of the flash evaporator is connected to one end of a stop valve by a first pipeline, the other end of the stop valve is connected to a first gas intake of the two-stage compressor by a second pipeline, the method of controlling gas replenishment comprises: obtaining a first temperature value Tm1 and an intermediate pressure value Pm in the first pipeline, and a second temperature value Tm2 in the second pipeline; and controlling the stop valve according to the first temperature value Tm1, the intermediate pressure value Pm and the second temperature value Tm2.

Optionally, in the aforementioned method of controlling gas replenishment of a two-stage compression air conditioning system, the control of the stop valve according to the first temperature value Tm1, the intermediate pressure value Pm and the second temperature value Tm2 specifically comprises: obtaining a saturation vapor temperature Tmc according to the intermediate pressure value Pm; obtaining a superheat degree SH of replenished gas according to the first temperature value Tm1 and the saturation vapor temperature Tmc, wherein SH=Tm1−Tmc; obtaining a front-rear temperature difference TH of the gas replenishing valve according to the first temperature value Tm1 and the second temperature value Tm2, wherein TH=Tm1−Tm2; controlling the stop valve according to the superheat degree SH of replenished gas and the front-rear temperature difference TH of the gas replenishing valve.

Optionally, in the aforementioned method of controlling gas replenishment of a two-stage compression air conditioning system, the control of the stop valve according to the superheat degree SH of replenished gas and the front-rear temperature difference TH of the gas replenishing valve specifically comprises: opening the stop valve if SH≥a and TH≥b; otherwise, closing the gas replenishing valve, wherein a and b are both preset values.

Optionally, in the aforementioned method of controlling gas replenishment of a two-stage compression air conditioning system, the control of the stop valve according to the superheat degree SH of replenished gas and the front-rear temperature difference TH of the gas replenishing valve is specifically as follows: the operation state of gas replenishment is determined according to the superheat degree SH of replenished gas and the front-rear temperature difference TH of the gas replenishing valve, and the stop valve is controlled according to the operation state of gas replenishment; the operation state of gas replenishment includes normal forward flow of replenished gas, back flow of replenished gas, and forward flow of replenished gas with liquid.

Optionally, in the aforementioned method of controlling gas replenishment of a two-stage compression air conditioning system, the determination of the operation state of gas replenishment according to the superheat degree SH of replenished gas and the front-rear temperature difference TH of the gas replenishing valve specifically comprises: determining the state as normal forward flow of replenished gas, if SH≥a and TH≥b; determining the state as back flow of replenished gas, if SH<a and TH<c; determining the state as forward flow of replenished gas with liquid, if SH<a and TH≥c, wherein a, b and c are all preset values.

Optionally, in the aforementioned method of controlling gas replenishment of a two-stage compression air conditioning system, the control of the stop valve according to the operation state of gas replenishment specifically comprises: opening the stop valve if the operation state of gas replenishment is normal forward flow of replenished gas; closing the stop valve if the operation state of gas replenishment is back flow of replenished gas or forward flow of replenished gas with liquid.

A two-stage compression air conditioning system, comprising a two-stage compressor and a flash evaporator, wherein a first port of the flash evaporator is connected to one end of a stop valve by a first pipeline, the other end of the stop valve is connected to a first gas intake of the two-stage compressor by a second pipeline; the system further comprises a first temperature sensing device, a second temperature sensing device, and an intermediate pressure sensor; wherein the first temperature sensing device and the intermediate pressure sensor are disposed on the first pipeline, and the second temperature sensing device is disposed on the second pipeline.

Optionally, in the aforementioned two-stage compression air conditioning system, the first temperature sensing device and the intermediate pressure sensor are disposed near the first port of the flash evaporator.

Optionally, in the aforementioned two-stage compression air conditioning system, the second temperature sensing device is disposed near the first gas intake of the two-stage compressor.

According to another aspect of the present disclosure, a computer-readable storage medium is provided, in which a computer program is stored, which program implements the steps of the method as described above when executed by a processor.

According to yet another aspect of the present disclosure, a computing control device is provided, comprising a memory, a processor, and a computer program stored in the memory and executable on the processor. The processor implements the steps of the method described above when executing the program.

In the solution of the present application, the occurrence of back flow of replenished gas is effectively reduced by obtaining the first temperature value Tm1 in the first pipeline, the intermediate pressure value Pm and the second temperature value Tm2 in the second pipeline and controlling the stop valve based on the abovementioned parameters.

BRIEF DESCRIPTION OF THE DRAWINGS

The abovementioned and other objects, features, and advantages of the present disclosure will become more apparent from the following description of the embodiments of the present disclosure with reference to the accompanying drawings. In the drawings.

DESCRIPTION OF THE INVENTION

The present disclosure is described below based on embodiments, but the present disclosure is not limited to these embodiments. In the following detailed description of the present disclosure, specific details are described in detail. Those skilled in the art can fully understand the present disclosure even without the description of these details. In order to avoid obscuring the essence of the present disclosure, commonly known methods, processes, procedures, and elements are not described in detail.

On this account, an object of the disclosure is to provide a method capable of determining and controlling back flow of replenished gas of a two-stage compressor, so as to avoid the occurrence of back flow of replenished gas.

Figure 1:
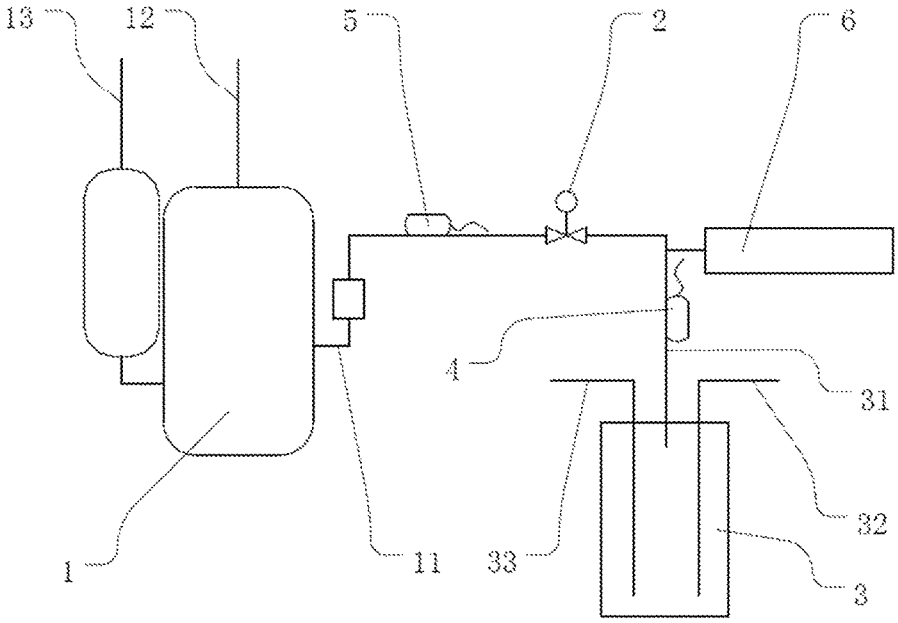
FIG. 1 is a schematic view of an embodiment of an air conditioning system of the present disclosure.

As shown in FIG. 1, according to a first embodiment of the present disclosure, an air conditioning system is provided, which comprises a two-stage compressor 1 and a flash evaporator 3. The two-stage compressor 1 has a first gas intake 11, a second gas intake 12 and a gas outlet 13. The flash evaporator comprises a first port 31, a second port 32, and a third port 33. The first port 31 is a port for increasing enthalpy and replenishing gas to the compressor. The first port 31 is connected to one end of a stop valve 2 by a first pipeline, and the other end of the stop valve 2 is connected to the first gas intake 11 of the two-stage compressor 1 by a second pipeline. The system further comprises a first temperature sensing device 4, a second temperature sensing device 5 and an intermediate pressure sensor 6; wherein the first temperature sensing device 4 and the intermediate pressure sensor 6 are disposed on the first pipeline between the stop valve 2 and the first port 31 of the flash evaporator 3, the first temperature sensing device 4 is used for detecting the first temperature Tm1 of replenished gas at the first port 31 of the flash evaporator 3, the intermediate pressure sensor 6 is used for detecting the intermediate pressure Pm at the first port 31 of the flash evaporator 3, and the second temperature detecting device 5 is disposed on the second pipeline between the stop valve 2 and the first gas intake 11 of the two-stage compressor 1, for detecting the second temperature value Tm2 at the first gas intake of the compressor. Optionally, the first temperature sensing device 4 and the intermediate pressure sensor 6 are disposed near the first port 31 of the flash evaporator, which can measure the temperature and pressure of the refrigerant at the first port 31 more accurately. "Near" herein means being closer to the first port 31 with respect to the midpoint of the first pipeline. Optionally, the second temperature sensing device 5 is disposed near the first gas intake 11 of the two-stage compressor 1, which can measure the temperature of the refrigerant at the first gas intake 11 more accurately. "Near" herein means being closer to the first gas intake 11 with respect to the midpoint of the second pipeline.

By controlling the opening and closing of the stop valve 2, gas replenishment can be controlled. When occurrence of situations such as back flow of replenished gas is detected, the stop valve 2 is closed in time, thereby ensuring a reliable and efficient operation of the compressor for a long time.

Figure 2:
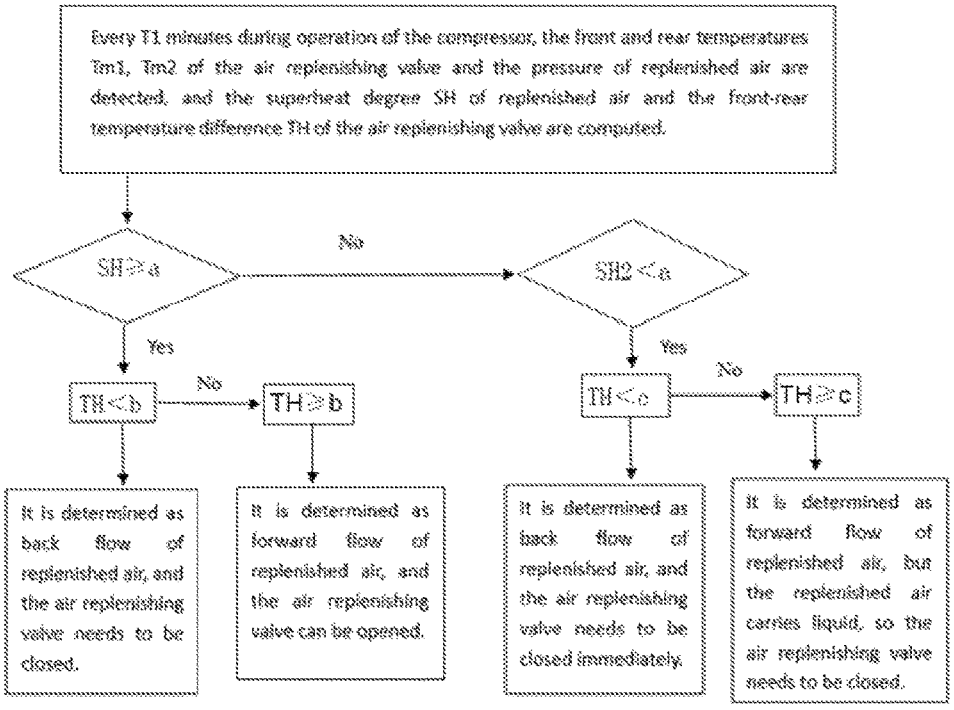
FIG. 2 is a flowchart of an embodiment of a method of controlling gas replenishment of a two-stage compression air conditioning system of the present disclosure.

With reference to FIG. 2, the present embodiment also provides a method of controlling gas replenishment of a two-stage compression air conditioning system, for controlling the abovementioned air conditioning system. The method comprises: obtaining the first temperature value Tm1 in the first pipeline, the intermediate pressure value Pm and the second temperature value Tm2 in the second pipeline; controlling the stop valve 2 based on the first temperature value Tm1, the intermediate pressure value Pm and the second temperature value Tm2. Optionally, the first temperature value Tm1 and the intermediate pressure value Pm are the temperature value and intermediate pressure value of the refrigerant near the first port 31 of the flash evaporator; and the second temperature value Tm2 is the temperature value of the refrigerant near the first gas intake of the two-stage compressor.

As a preferred embodiment, the control of the stop valve according to the first temperature value Tm1, the intermediate pressure value Pm and the second temperature value Tm2 specifically comprises: obtaining a saturation vapor temperature Tmc according to the intermediate pressure value Pm, wherein the specific saturation vapor temperature Tmc can be obtained by querying a comparison table of saturation temperatures and pressures of refrigerant to find the saturation vapor temperature Tmc corresponding to the intermediate pressure value Pm; obtaining a superheat degree SH of replenished gas according to the first temperature value Tm1 and the saturation vapor temperature, wherein SH=Tm1−Tmc; obtaining a front-rear temperature difference TH of the gas replenishing valve according to the first temperature value Tm1 and the second temperature value Tm2, wherein TH=Tm1−Tm2; and controlling the stop valve according to the superheat degree SH of replenished gas and the front-rear temperature difference TH of the gas replenishing valve.

As a preferred embodiment, the control of the stop valve according to the superheat degree SH of replenished gas and the front-rear temperature difference TH of the gas replenishing valve specifically comprises: opening the stop valve, if SH≥a and TH≥b; otherwise, closing the gas replenishing valve; wherein, both a and b are obtained in advance based on experience or are preset values obtained according to experiments, and the same or different values may be chosen for different air conditioning systems and different compressor parameters.

In the solution of the present application, specifically, the superheat degree SH of replenished gas and the front-rear temperature difference TH of the gas replenishing valve are obtained according to the first temperature valve Tm1 at the first port of the flash evaporator, the intermediate pressure value Pm and the second temperature value Tm2 at the first gas intake of the compressor, and the stop valve is controlled according to the superheat degree SH of replenished gas and the front-rear temperature difference TH of the gas replenishing valve.

The specific principle of the abovementioned control of the stop valve according to the superheat degree SH of replenished gas and the front-rear temperature difference TH of the gas replenishing valve is as follows: the operation state of gas replenishment is determined according to the superheat degree SH of replenished gas and the front-rear temperature difference TH of the gas replenishing valve, and the stop valve is controlled according to the operation state of gas replenishment; the operation state of gas replenishment includes normal forward flow of replenished gas, back flow of replenished gas, and forward flow of replenished gas with liquid.

The state is determined as normal forward flow of replenished gas, if SH≥a and TH≥b; the state is determined as back flow of replenished gas, if SH≥a and TH<b, or if SH<a and TH<c; the state is determined as forward flow of replenished gas with liquid, if SH<a and TH≥c; wherein, a, b and c are all obtained in advance based on experience or are preset values obtained according to experiments, the same or different values may be chosen for different air conditioning systems and different compressor parameters, which are related to the configuration positions of the stop valve, temperature sensing devices and the intermediate pressure sensor.

Optionally, the first temperature value Tm1, the saturation vapor temperature Tmc, the superheat degree SH of replenished gas, the second temperature value Tm2, the front-rear temperature difference TH of the gas replenishing valve, and a, b, c are all in degrees Celsius.

If the operation state of gas replenishment is normal forward flow of replenished gas, which indicates that gas replenishment and enthalpy increase are operated normally, the stop valve is opened; wherein the normal forward flow of replenished gas means that the flash evaporator can replenish gas and increase enthalpy for the compressor, and the refrigerant supplied to the compressor is a gaseous refrigerant.

If the operation state of gas replenishment is back flow of replenished gas, since back flow of replenished gas will reduce the discharge amount of lubricating oil of the compressor, which will detrimentally affect the long-term reliability of the compressor, the stop valve should be closed to prevent back flow of replenished gas.

If the operation state of gas replenishment is forward flow of replenished gas with liquid, it indicates that the refrigerant supplied by the flash evaporator to the compressor contains a liquid refrigerant. Since the liquid refrigerant may damage the compressor after entering the compressor through the first gas intake, the stop valve should be closed at this time to ensure safe operation of the compressor.

During gas replenishment, the normal flow of refrigerant is from the flash evaporator to the intermediate-pressure cylinder of the compressor. In normal flow of replenished gas without liquid, the superheat degree of replenished gas is required to be higher than a preset value. Due to the throttling of the stop valve, there will be a front-rear temperature difference of the stop valve. The temperature difference will be more obvious in forward flow of replenished gas with liquid. The temperature difference in back flow of replenished gas is contrary to the temperature difference in forward flow. The operation state of gas replenishment can be determined according to the abovementioned principle in combination with the superheat degree SH of replenished gas and the front-rear temperature difference TH of the gas replenishing valve.

In the solution of the present application, the operation state of gas replenishment is determined according to the superheat degree SH of replenished gas and the front-rear temperature difference TH of the gas replenishing valve, and the stop valve is controlled according to the operation state of gas replenishment, thus accurately determining and controlling back flow of replenished gas.

By timely and reasonable control of the stop valve, the service life of the two-stage compressor can be extended, and at the same time, the two-stage compression air-conditioning system can maintain efficient, stable, and long-term reliable operation.

Figure 3:
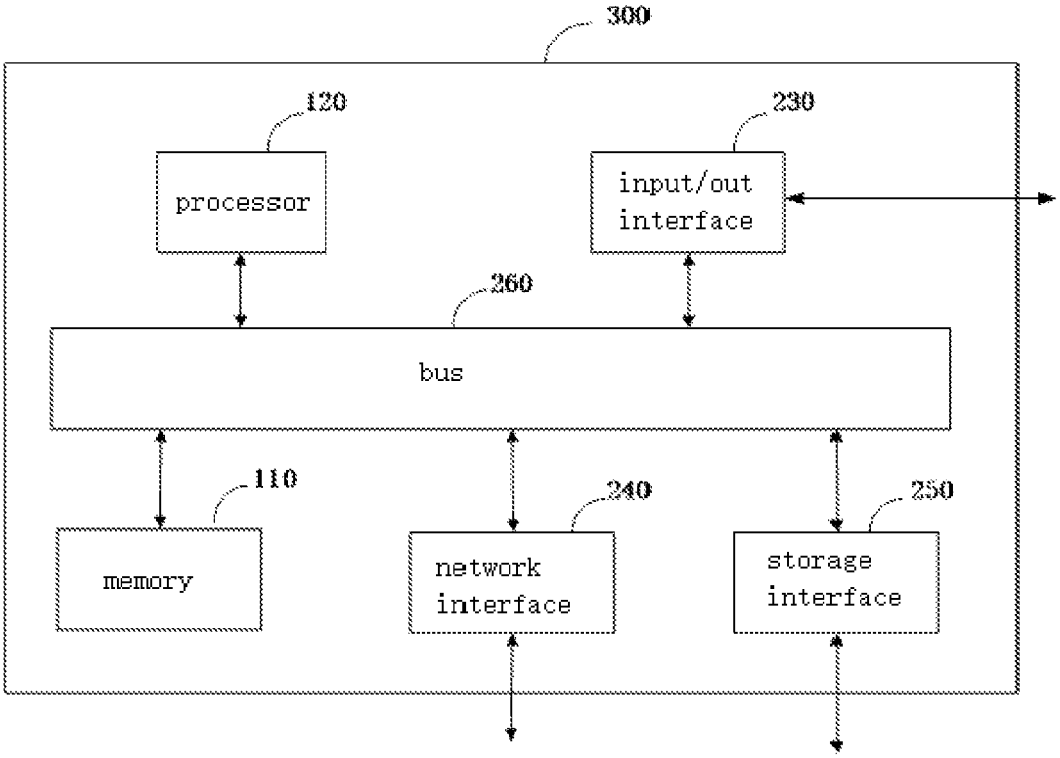
FIG. 3 is a schematic view of an embodiment of a computing control device implementing the method of controlling gas replenishment of a two-stage compression air conditioning system of the present disclosure.

FIG. 3 is a schematic view of an embodiment of the computing control device implementing the method of controlling gas replenishment of a two-stage compression air conditioning system of the present disclosure. As shown in FIG. 3, the control device 300 of the embodiment comprises a memory 110 and a processor 120, and may further comprise an input/output interface 230, a network interface 240, a storage interface 250, and the like. These interfaces 230, 240, 250 and the memory 110 and the processor 120 therebetween maybe connected by a bus 260, for example. The input/output interface 230 provides a connection interface for input/output devices such as a remote controller, a display, a touch screen, a mouse, a keyboard, and the like. The network interface 240 provides a connection interface for various networking devices, such as connection to a database server or a cloud storage server. The storage interface 250 provides a connection interface for external storage devices such as SD cards and U disks.

Those skilled in the art should understand that, the embodiments of the present disclosure may be provided as a method, a system, or a computer program product. Thus, the present disclosure may take the form of an entirely hardware embodiment, an entirely software embodiment, or an embodiment with software and hardware aspects combined. Furthermore, the present disclosure may take the form of a computer program product implemented on one or more computer-usable non-transitory storage media (including but not limited to a disk storage, CD-ROM, an optical memory, and the like) containing computer-usable program code therein.

The present disclosure is described with reference to a flowchart and/or a block diagram of the method, the device (system) and the computer program product according to the embodiments of the present disclosure. It should be understood that, each process and/or block in the flowchart and/or block diagram and combinations of processes and/or blocks in the flowchart and/or block diagram can be implemented by computer program instructions. These computer program instructions may be provided to a processor of a general-purpose computer, a special-purpose computer, an embedded processor, or other programmable data processing devices to generate a machine, such that the instructions executed by the processor of a computer or other programmable data processing devices generate a device for implementing the functions specified in one or more processes of the flowchart and/or one or more blocks of the block diagram.

These computer program instructions may also be stored in a computer readable memory capable of guiding a computer or other programmable data processing devices to operate in a specific manner, such that the instructions stored in the computer readable memory generate an article of manufacture comprising an instructing device which implements the functions specified in one or more processes of the flowchart and/or one or more blocks of the block diagram.

These computer program instructions can also be loaded onto a computer or other programmable data processing devices, such that a series of operating steps are performed on the computer or other programmable devices to generate computer-implemented processing, thus, the instructions executed on the computer or other programmable devices provide steps for implementing the functions specified in one or more processes of the flowchart and/or one or more blocks of the block diagram.

Besides, those of ordinary skill in the art should understand that, the drawings provided herein are all for the purpose of illustrating the disclosure and the drawings are not necessarily drawn to scale.

At the same time, it should be understood that, exemplary embodiments are provided so that this disclosure will be comprehensive, and will fully convey the scope of the disclosure to those skilled in the art. Many specific details (e.g. examples of specific components, devices and methods) are given to provide a thorough understanding of the disclosure. Those skilled in the art will understand that, specific details are not required to be used, exemplary embodiments may be implemented in many different forms, and exemplary embodiments should not be construed as limiting the scope of the disclosure. In some exemplary embodiments, well-known devices, structures and technology are not described in detail.

It will be understood that, when an element or layer is referred to as being "on", "engaged to", "connected to" or "coupled to" another element or layer, it may be directly on, directly engaged to, connected to or coupled to the other element or layer, or an intervening element or layer may be present. In contrast, when an element is referred to as being "directly on", "directly engaged to", "directly connected to" or "directly coupled to" another element or layer, no intervening elements or layers are present. Other words used to describe the relationship between elements should be interpreted in a similar way (e. g. "between" and "directly between," "adjacent," and "directly adjacent," etc.). As used herein, the term "and/or" includes any or all combinations of one or more of the associated listed items.

What is claimed is:

1. A method of controlling gas replenishment of a two-stage compression air conditioning system, the two-stage compression air conditioning system comprising a two-stage compressor and a flash evaporator, wherein a first port of the flash evaporator is connected to one end of a stop valve by a first pipeline, the other end of the stop valve is connected to a first gas intake of the two-stage compressor by a second pipeline, wherein the method of controlling gas replenishment comprises:

obtaining a first temperature value (Tm1) and an intermediate pressure value (Pm) in the first pipeline, and a second temperature value (Tm2) in the second pipeline;

controlling the stop valve according to the first temperature value (Tm1), the intermediate pressure value (Pm) and the second temperature value (Tm2);

wherein the control of the stop valve according to the first temperature value (Tm1), the intermediate pressure value (Pm) and the second temperature value (Tm2) comprises:

obtaining a saturation vapor temperature (TmC) according to the intermediate pressure value (Pm);

obtaining a superheat degree (SH) of replenished gas according to the first temperature value (Tm1) and the saturation vapor temperature (TmC), wherein SH=Tm1−TmC;

obtaining a front-rear temperature difference (TH) of the stop valve according to the first temperature value (Tm1) and the second temperature value (Tm2), wherein TH=Tm1−Tm2 ; and controlling the stop valve according to the superheat degree (SH) of replenished gas and the front-rear temperature difference (TH) of the stop valve.

2. The method of controlling gas replenishment of a two-stage compression air conditioning system according to claim 1, wherein the control of the stop valve according to the superheat degree (SH) of replenished gas and the front-rear temperature difference (TH) of the stop valve comprises:

opening the stop valve, if SH≥a and TH≥b;

otherwise, closing the stop valve;

wherein a and b are both preset values.

3. The method of controlling gas replenishment of a two-stage compression air conditioning system according to claim 1, wherein the control of the stop valve according to the superheat degree (SH) of replenished gas and the front-rear temperature difference (TH) of the stop valve comprises:

determining an operation state of gas replenishment according to the superheat degree (SH) of replenished gas and the front-rear temperature difference (TH) of the stop valve; and controlling the stop valve according to the operation state of gas replenishment, wherein the operation state of gas replenishment comprises normal forward flow of replenished gas, back flow of replenished gas, or forward flow of replenished gas with liquid.

4. The method of controlling gas replenishment of a two-stage compression air conditioning system according to claim 3, wherein the determination of the operation state of gas replenishment according to the superheat degree (SH) of replenished gas and the front-rear temperature difference (TH) of the stop valve comprises:

determining the operation state as normal forward flow of replenished gas, if SH≥a and TH≥b;

determining the operation state as back flow of replenished gas, if SH≥a and TH<b, or if SH<a and TH<c; and determining the operation state as forward flow of replenished gas with liquid, if SH<a and TH≥c;

wherein a, b and c are all preset values.

5. The method of controlling gas replenishment of a two-stage compression air conditioning system according to claim 3, wherein the control of the stop valve according to the operation state of gas replenishment comprises:

opening the stop valve, if the operation state of gas replenishment is normal forward flow of replenished gas; and closing the stop valve, if the operation state of gas replenishment is back flow of replenished gas or forward flow of replenished gas with liquid.

6. A two-stage compression air conditioning system comprising a two-stage compressor and a flash evaporator, wherein a first port of the flash evaporator is connected to one end of a stop valve by a first pipeline, and the other end of the stop valve is connected to a first gas intake of the two-stage compressor by a second pipeline, the system further comprising a first temperature sensing device, a second temperature sensing device, an intermediate pressure sensor, and a computing control device; wherein the first temperature sensing device and the intermediate pressure sensor are disposed on the first pipeline, the second temperature sensing device is disposed on the second pipeline, the first temperature sensing device obtains a first temperature value (Tm1) in the first pipeline, the second temperature sensing device obtains a second temperature value (Tm2) in the second pipeline, and the intermediate pressure sensor obtains an intermediate pressure value (Pm) in the first pipeline;

the computing control device obtains a saturation vapor temperature (TmC) according to the intermediate pressure value (Pm); obtains a superheat degree (SH) of replenished gas according to the first temperature value (Tm1) and the saturation vapor temperature (TmC), wherein SH =Tm1−TmC; obtains a front-rear temperature difference (TH) of a stop valve according to the first temperature value (Tm1) and the second temperature value (Tm2), wherein TH=Tm1−Tm2; and controls the stop valve according to the superheat degree (SH) of replenished gas and the front-rear temperature difference (TH) of the stop valve.

7. The two-stage compression air conditioning system according to claim 6, wherein the first temperature sensing device and the intermediate pressure sensor are disposed near the first port of the flash evaporator.

8. The two-stage compression air conditioning system according to claim 6, wherein the second temperature sensing device is disposed near the first gas intake of the two-stage compressor.

9. The method of controlling gas replenishment of a two-stage compression air conditioning system according to claim 4, wherein, the control of the stop valve according to the operation state of gas replenishment specifically comprises:

opening the stop valve, if the operation state of gas replenishment is normal forward flow of replenished gas;

closing the stop valve, if the operation state of gas replenishment is back flow of replenished gas or forward flow of replenished gas with liquid.

10. A computing control device, comprising a memory, a processor, and a computer program stored in the memory and executable on the processor, wherein, the processor implements the steps of the method according to claim 1 when executing the program.

11. A computing control device, comprising a memory, a processor, and a computer program stored in the memory and executable on the processor, wherein, the processor implements the steps of the method according to claim 2 when executing the program.

12. A computing control device, comprising a memory, a processor, and a computer program stored in the memory and executable on the processor, wherein, the processor implements the steps of the method according to claim 3 when executing the program.

13. A computing control device, comprising a memory, a processor, and a computer program stored in the memory and executable on the processor, wherein, the processor implements the steps of the method according to claim 4 when executing the program.

14. A computer-readable storage medium, in which a computer program is stored, wherein, the program implements the steps of the method according to claim 1 when executed by the processor.

15. A computer-readable storage medium, in which a computer program is stored, wherein, the program implements the steps of the method according to claim 2 when executed by the processor.

16. A computer-readable storage medium, in which a computer program is stored, wherein, the program implements the steps of the method according to claim 3 when executed by the processor.

17. A computer-readable storage medium, in which a computer program is stored, wherein, the program implements the steps of the method according to claim 4 when executed by the processor.

* * * * *